United States Patent [19]

Logan

[11] Patent Number: 4,467,571

[45] Date of Patent: Aug. 28, 1984

[54] CONSTRUCTION UNITS AND ASSEMBLIES, AND STRUCTURES FABRICATED FROM SUCH UNITS AND ASSEMBLIES

[76] Inventor: William F. Logan, #70 Laight St. - 5th Floor, New York, N.Y. 10013

[21] Appl. No.: 272,139

[22] Filed: Jun. 10, 1981

[51] Int. Cl.[3] ..... E04B 1/346

[52] U.S. Cl. ..... 52/63; 52/64; 52/80; 52/222; 52/86

[58] Field of Search ..... 52/2, 63, 64, 71, 80, 52/82, 83, 86, 88, 222, 245; 135/DIG. 1

[56] References Cited

U.S. PATENT DOCUMENTS

| | | | |
|---|---|---|---|
| 1,608,242 | 11/1926 | Sava | 135/DIG. 1 |
| 3,134,198 | 5/1964 | Calthorpe | 52/86 X |
| 3,741,631 | 6/1973 | Laing | 52/2 X |
| 3,802,450 | 4/1974 | Huddle | 135/DIG. 1 |
| 3,925,942 | 12/1975 | Hemmelsbach | 52/93 X |
| 3,990,194 | 11/1976 | Huddle | 52/80 |
| 4,118,904 | 10/1978 | Sprung | 52/63 |
| 4,241,746 | 12/1980 | Rothe | 52/80 X |
| 4,265,260 | 5/1981 | Gillis | 52/80 X |

FOREIGN PATENT DOCUMENTS

| | | | |
|---|---|---|---|
| 217377 | 9/1961 | Austria | 52/245 |
| 455214 | 6/1968 | Switzerland | 52/86 |

*Primary Examiner*—Henry E. Raduazo
*Attorney, Agent, or Firm*—Ladas & Parry

[57] ABSTRACT

This invention relates to construction units and assemblies, and to structures fabricated from such units and assemblies, and is particularly concerned with stressed membrane structures, and specifically with modular, multiple membrane structures.

7 Claims, 14 Drawing Figures

CONSTRUCTION UNITS AND ASSEMBLIES, AND STRUCTURES FABRICATED FROM SUCH UNITS AND ASSEMBLIES

Stressed membrane structures are disclosed in U.S. Pat. No. 3,990,194 (Huddle) and U.S. Pat. No. 4,137,687 (Sprung). U.S. Pat. No. 3,925,942 (Hemmelsbach) discloses a modular structure of interconnected tubular members.

Considerable advances have recently been made in the fabrication of high-performance, durable, structural coated-fabrics. The present invention is concerned with providing a support system for such fabrics which enables them to be utilized in the most appropriate manner taking into consideration issues such as prefabrication, standardization, ease of erection on site, replaceability, and dimensional predictability.

According to one aspect of the present invention there is provided a construction assembly comprising a first and second similar generally rectangular frameworks each having first and second parallel opposite sides and first and second parallel opposite ends, articulation means connecting the first end of the first framework to the second end of the second framework, so that the plane of the first framework is inclined to the plane of the second framework and the first sides of the first and second frameworks are substantially coplanar and the second sides of the first and second frameworks are substantially coplanar, first and second arch structures each of which has two end portions separated by a distance substantially equal to the distance between the opposite sides of each framework and an intermediate portion which connects the two end portions together, means connecting the two end portions of the first arch structure to the first framework at the first end thereof so that the intermediate portion of the first arch structure is spaced from the plane of the first framework and the distance of the intermediate portion of the first arch structure from the second end of the first framework is variable, means connecting the two end portions of the second arch structure to the second framework at the second end thereof so that the intermediate portion of the second arch structure is spaced from the plane of the second framework and the distance of the intermediate portion of the second arch structure from the first end of the second framework is variable, means for restricting movement of the arch structures relative to each other, a first portion of sheet material having edge regions connected respectively to the first arch structure and the first and second opposite sides of the first framework, a second portion of sheet material having edge regions connected respectively to the second arch structure and the first and second opposite sides of the second framework and a third portion of sheet material having edge regions connected respectively to the first and second sides of the first and second frameworks, the first and second frameworks lying between the third portion of sheet material and the first and second portions of sheet material.

For a better understanding of the invention, and to show how the same may be carried into effect, reference will now be made by way of example, to the accompanying drawings in which.

Figure 1:
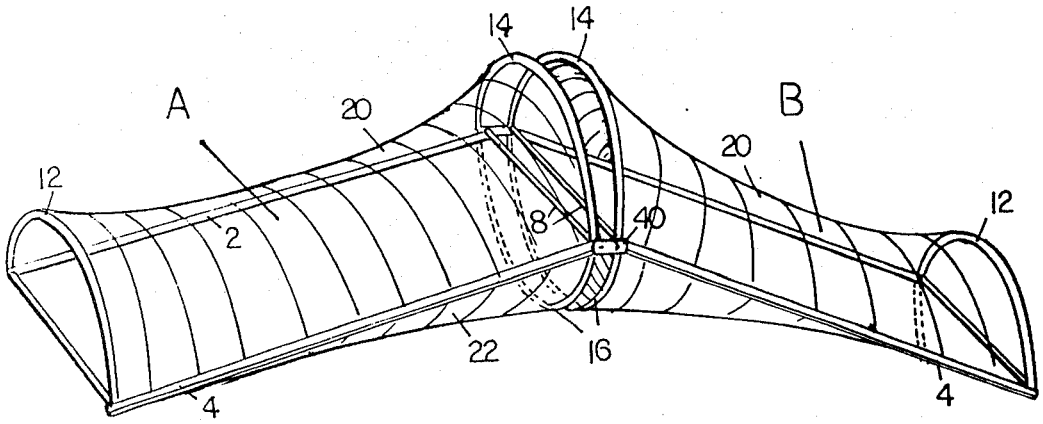
FIG. 1 is a perspective view of a first embodiment of the invention.

FIG. 1 illustrates two construction units A, B connected together to provide a roof module. The two construction units are connected together at the ends 8 by means of links 40 which permit relative pivotal movement of the frameworks 10. The frameworks are oriented with their planes at 140° to each other, each being inclined at 20° to the horizontal. In this orientation, when the skins 20 and 22 (which are made of waterproof material) are stressed by pivoting the arches 12, 14 and 16 to the angles $\alpha$, $\beta$ and $\gamma$ respectively relative to the respective frameworks 10, the arches 14 are disposed about vertically and form the peak of the roof. The gap between the two skins 20 at the peak of the roof can be sealed by means of a capping strip 92 as described below with reference to FIG. 8.

Figure 2:
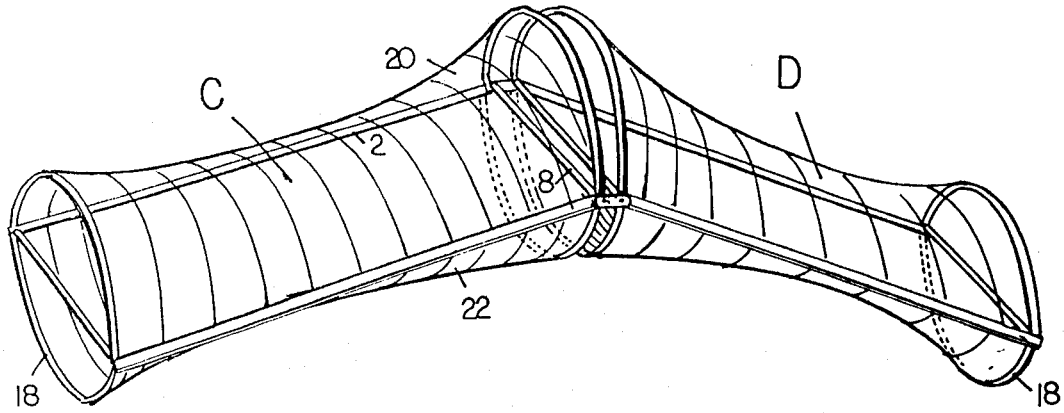
FIG. 2 is a perspective view of a second embodiment of the invention.

FIG. 2 shows two construction units C and D connected together. As shown, the end 8 of the unit C is connected to the end 8 of the unit D. As in the case of FIG. 1, the construction units are connected together end-to-end by means of links 40. The frameworks are oriented with their planes at 160° to each other and at 10° to the horizontal.

Figure 3:
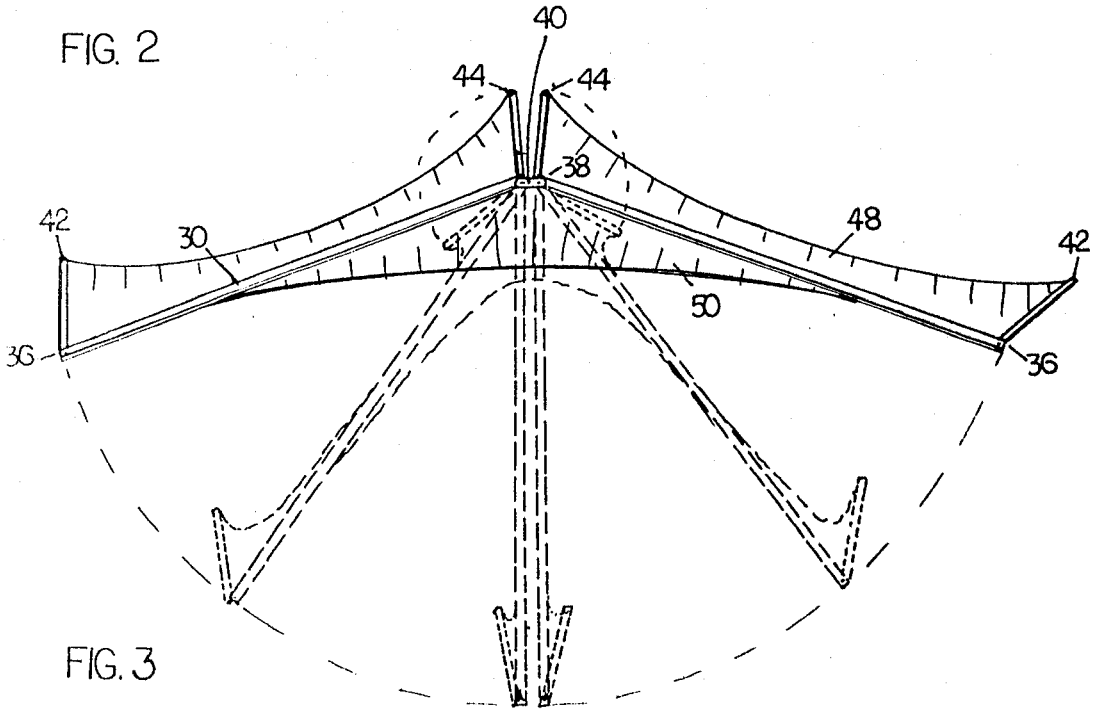
FIG. 3 is a side elevation of a foldable construction assembly when in the unfolded conditions.
Figure 4:
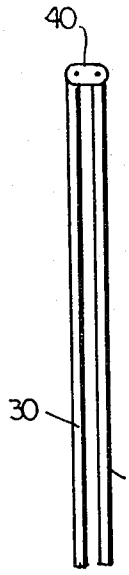
FIG. 4 is a side elevation of the FIG. 3 construction assembly when in the folded condition.
Figure 5:
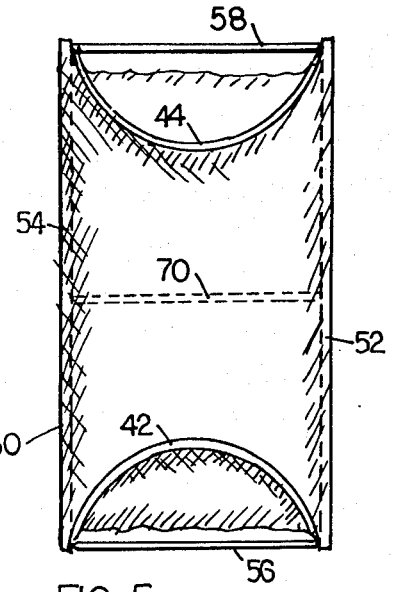
FIG. 5 is a plan view of the FIG. 3, construction assembly when in the folded condition.
Figure 6:
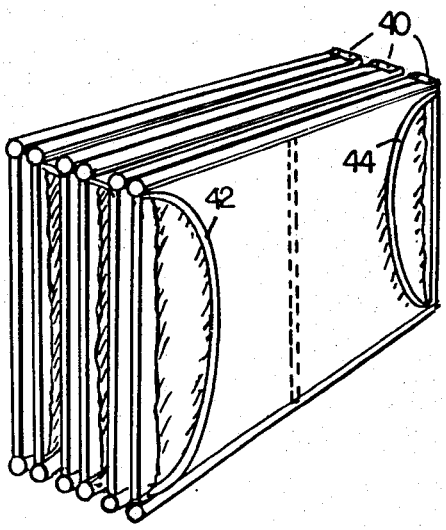
FIG. 6 is a side elevation illustrating a stack of several folded construction assemblies.

FIG. 3 illustrates a construction assembly which comprises two frameworks 30 each having two sides 32,34 and two ends 36,38, connected together end-to-end by links 40. Each framework has, at its upper side, two arches 42 and 44 which are pivoted to the framework at the ends 36 and 38 respectively. An upper skin 48 is secured to the arches and edges of each framework, and a common lower skin 50 is secured to the edges of and to the end 36 of each framework. The assembly is foldable, as shown in FIGS. 4 and 5 and in broken lines in FIG. 3. In the folded disposition, the frameworks 30 confront each other in parallel relation and the arches 42 and 44 are folded down onto the respective frameworks. When the assembly is unfolded, the frameworks are pivoted relative to each other through an angle of about 140°, and at this orientation the lower skin 50 is tight. The upper arches 42 and 44 of each framework are pivoted away from each other. When the arches 42 and 44 of the left framework are parallel to each other, each extending at substantially 70° to the plane of the framework 30, the upper skin 48 of the left framework is tight. When the arch 44 of the right framework extends about parallel to the arch 44 of the left framework, and the arch 42 of the right framework is disposed at substantially 50° to the plane of the right framework, the upper skin 48 of the right framework is tight. The construction unit can be used as part of the roof of a building, as described in further detail below with reference to FIGS. 16 and 17. As shown in FIG. 6, several of the folded construction assemblies can be stacked on top of each other for transportation.

Figure 7:
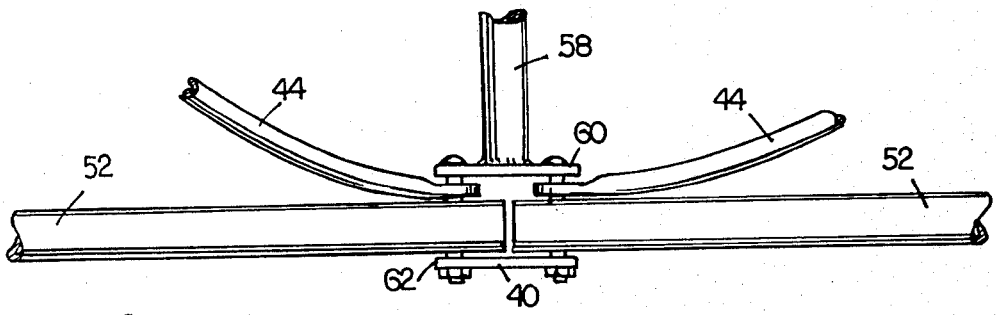
FIG. 7 is an enlarged plan view of a detail of the FIG. 3 construction assembly.
Figure 8:
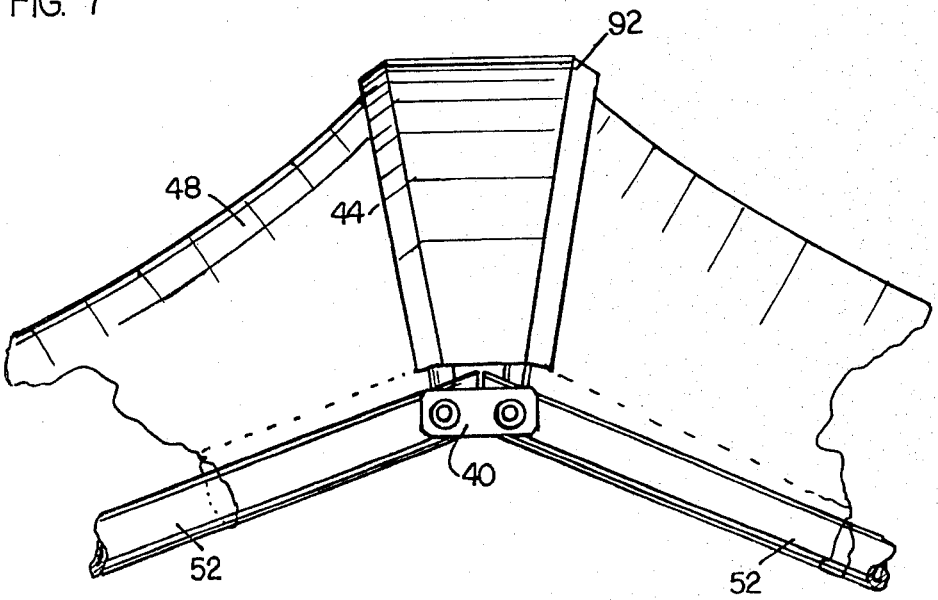
FIG. 8 is an enlarged side elevation of a detail of the FIG. 3 construction assembly.

FIGS. 7 and 8 illustrate the connection between the frameworks 30. As shown in FIG. 5, each framework 30 has two longitudinal members 52,54, defining the sides 32,34 respectively, and a lateral member 56 defining the end 36. The end of each of the members 52 and 54 which is nearer the other member 52 or 54 is pivotally connected to the other member 52 or 54 by means of the link 40, which comprises two plates 60 and 62 between which the ends of the members 52 or 54 are received. The plates 60 of the two links are connected to a lateral member 58 which defines the ends 38 of the two frameworks. The ends of the arches 44 are also received between and pivotally connected to the plates 60 and 62.

As shown in FIG. 7, the two arches 44 are held substantially parallel to each other by means of a connector which comprises a turnbuckle 90 and a spring 91 and is connected to the tops of the two arches 44. The turnbuckle 90 permits adjustment of the relative orientation of the two arches, while the spring 91 serves to maintain the skins in stressed condition even when the skins become enlarged, for example due to creep or to stretching under continued exposure to high temperatures.

FIG. 8 shows a capping strip 92 which covers the gap between the arches 44. The strip 92 is made of a metal or plastic sheet. In order that the strip may float relative to the arches, and thus not interfere with relative movement of the arches, it is preferably maintained in position by being secured to the connector 90,91.

Figure 9:
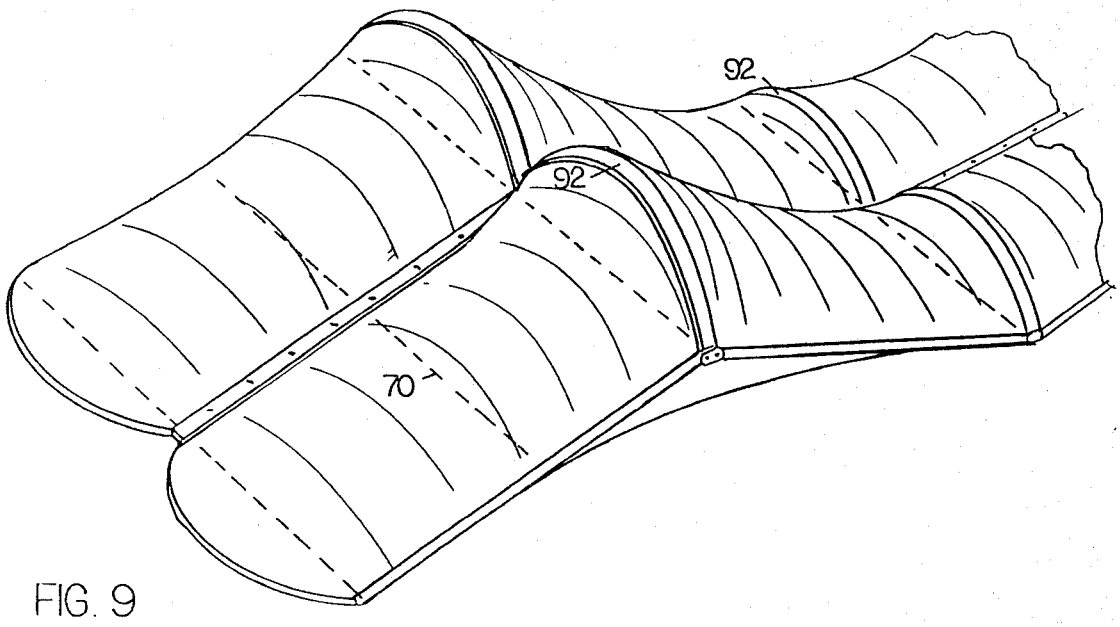
FIG. 9 is a perspective view of two FIG. 3 construction assemblies connected together side-by-side.

Two frameworks (whether parts of construction units shown in FIGS. 1 and 2 or parts of a construction assembly as shown in FIGS. 3 to 8) can readily be secured together side-by side, as shown in FIGS. 9 to 12. FIG. 9 shows two construction assemblies as shown in FIG. 6 secured together side-by-side, but the principles are equally applicable to the construction units described above.

Figure 10:
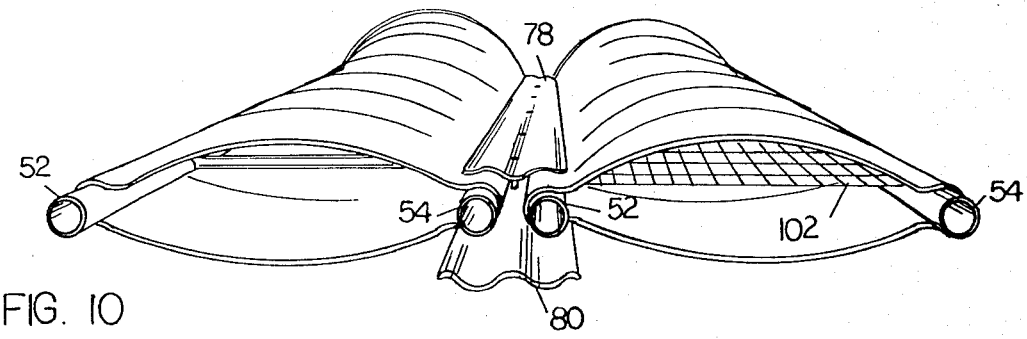
FIG. 10 is a sectional view showing a seal between the construction assemblies.
Figure 11:
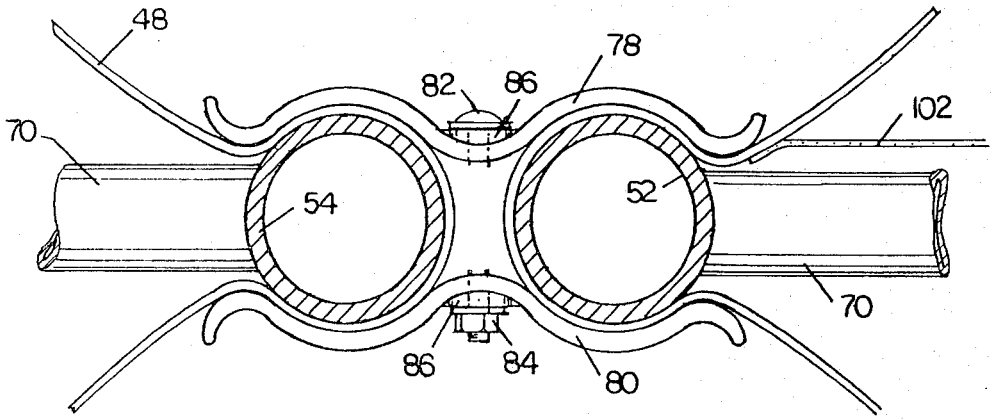
FIG. 11 is an enlarged view of a detail of FIG. 10.

As described with reference to FIG. 5, each of the frameworks includes two longitudinal members 52,54 and two lateral members 56,58. (The member 58 is shared between the two frameworks.) In addition, the framework includes a lateral strut 70 for holding the longitudinal members apart. The upper and lower skins of each unit or assembly are, as shown in FIGS. 10 and 11, formed by a single sheet of material which passes around the longitudinal members at the edge of the framework. The two frameworks are placed side-by-side and metal capping strips 78,80 are positioned respectively above and below the adjacent longitudinal members 52 and 54. The two capping strips are formed with aligned openings, and the adjacent assemblies are secured together by means of bolts 82 which pass through each pair of aligned openings from above and threadedly engage nuts 84 which are positioned below the lower capping strip 80. Resilient washers 86 are positioned on the bolt, between the head and the upper capping strip 78 and between the nut 84 and the lower capping strip 80. It will be seen from inspection of FIG. 17 that the upper resilient washer 86 and the upper capping strip 78 provide a substantially water-tight seal of the join between the adjacent construction assemblies. The capping strips also serve to ensure that the skin extends a substantial distance around the longitudinal members and is held tight, rather than flapping loosely between the longitudinal members.

Figure 12:
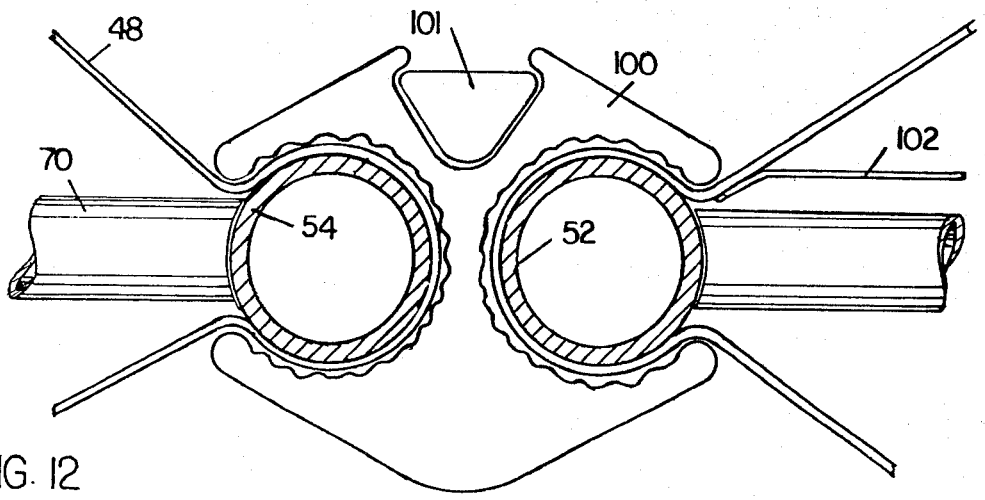
FIG. 12 is a similar view of a modification of FIG. 11.

FIG. 12 illustrates an alternative way of securing two frameworks together side-by-side, by use of a so-called zipper gasket. The zipper gasket comprises a gripping member 100 and a key 101. The gripping member is an extrusion of flexible material such as neoprene, so that upon removal of the key 101 the upper wings of the gripping member may be bent upwardly, away from the lower wings, allowing insertion of the longitudinal members 52 and 54 into the spaces defined between the pairs of wings. When the key 101 is placed in the groove formed on the top of the gripping member, upward bending movement of the wings is prevented, and the pairs of wings thus serve to grip the longitudinal members. The key 101 is also flexible, in that it can be bent, and may be made of metal or synthetic plastic.

Figure 13:
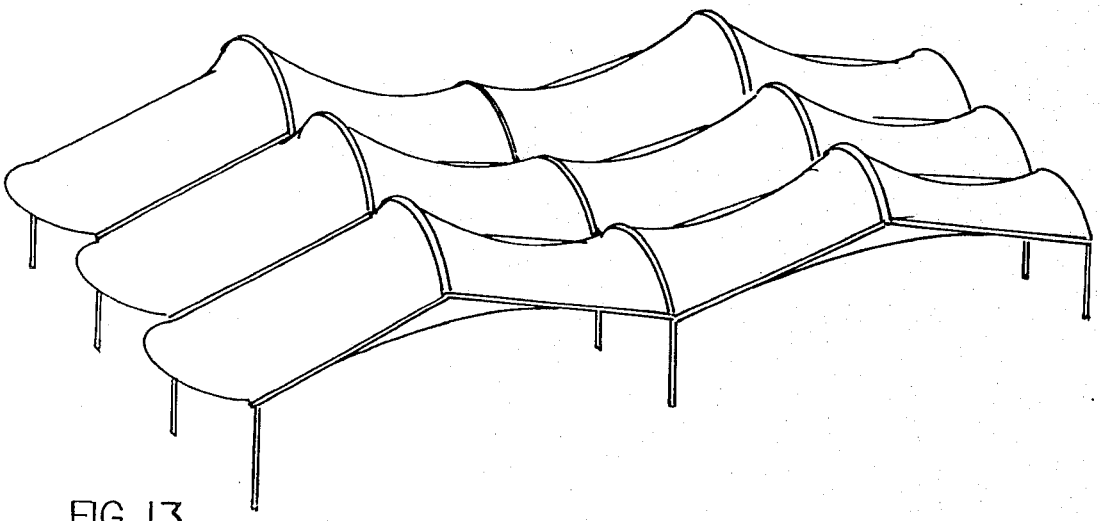
FIG. 13 is a perspective view of a building formed from construction assemblies as shown in FIG. 3.
Figure 14:
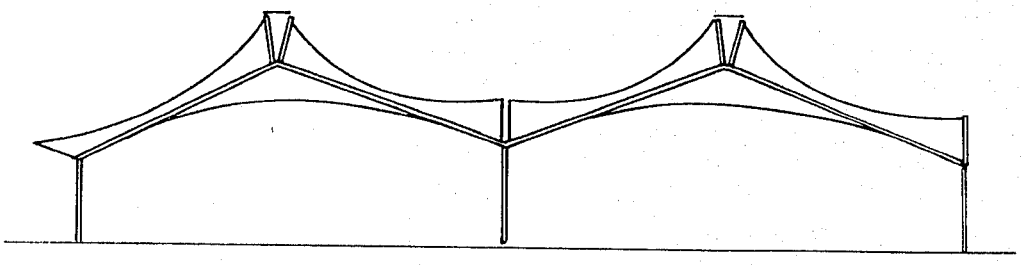
FIG. 14 is a side elevation of the FIG. 13 building.

The building illustrated in FIGS. 13 and 14 is formed by assembling several units or assemblies as described above. Thus, the building comprises two rows of three assemblies. Each construction assembly could be as illustrated in FIG. 3, or could alternatively be formed from two units connected together in end-to-end relationship as described with reference to FIG. 1. In either case, the assemblies are supported at their opposite ends upon legs, and the weight of the assembly and the springs 91 between the arches 14 or 44 maintains the lower skin taut. As shown in FIG. 14, the left-most arch 12 or 42 provides an overhang, whereas the right-most arch 12 or 42 is vertical, to permit placement of the building against an existing wall or connection to an additional row of construction assemblies.

It will be appreciated that the upper skin of the illustrated building is stressed simply by movement of the arches, without affecting the dispositions of the frameworks or the relationship between the frameworks and the footings on which they are supported or any partition which might be provided in the building. By using both upper and lower skins, a finished and appropriate surface may be provided on both the interior and the exterior of the building and the thermal energy performance of the building may be improved. The individual modules can be prefabricated under controlled conditions and with standardized dimensions, thereby reducing structural flaws while increasing design flexibility. The modules can be folded compactly for storage and transportation, and unfolded on site to reduce erection time and dependence on favorable weather conditions. An unlimited area may be covered by indefinite addition of modules in both the longitudinal and lateral directions.

It will be appreciated that in the illustrated buildings an air space is formed between the upper and lower skins. This air space can be used in several different ways. Thus, a static air space has good thermal insulation qualities and prevents loss of heat from the building. If the upper skin is dark, it can be used as a solar energy collector, in which case the air between the skins can be circulated and used as a heat transfer fluid. Yet again, a third skin could be provided in the plane of the framework, between the upper and lower skins, as shown at 102 in FIGS. 10 and 11, so as to divide the air space into two compartments. This third skin, if made of fabric cut on the bias with respect to the framework, can be used to maintain the framework in its proper rectangular configuration. If the upper skin is made of transparent material and the middle skin is black, the upper compartment serves as an effective energy collector. Heat can be extracted either by removing heated air from the upper compartment, or, if the middle skin is made of water proof material, trickling water over the middle skin running from the upper end of the framework to the lower end and removing the water which is thereby heated. If the middle skin is not required to withstand any mechanical load, it may be made movable, similar to a roller blind. By this means, the middle skin could be made reflective at night, so as to minimize loss of heat, and light transmissive during the day. This would be particularly useful in the case of a greenhouse.

The use of upper and lower skins with straight parallel members and arches to prestress the skins provides a structure which is highly efficient at withstanding weather loads. For example, a snow load is effective on the upper skin and is transferred thereby to the arches, with the result that the longitudinal members receive axially compressive loads. In the case of an open sided building, wind load is effective against the lower skin, which again results in axially compressive loads upon the longitudinal members.

In the foregoing, reference has been made to longitudinal and lateral members, and to sides and ends of the frameworks. This should not, however, be taken as limiting the disclosure to units and assemblies in which the distance between arches is greater than the distance between opposite ends of a given arch.

I claim:

1. A construction assembly comprising a first and second similar generally rectangular frameworks each having first and second parallel opposite sides and first and second parallel opposite ends, articulation means connecting the first end of the first framework to the second end of the second framework, so that the plane of the first framework is inclined to the plane of the second framework and the first sides of the first and second frameworks are substantially coplanar and the second sides of the first and second frameworks are substantially coplanar, first and second arch structures each of which has two end portions separated by a distance substantially equal to the distance between the opposite sides of each framework and an intermediate portion which connects the two end portions together, means connecting the two end portions of the first arch structure to the first framework at the first end thereof so that the intermediate portion of the first arch structure is spaced from the plane of the first framework and the distance of the intermediate portion of the first arch structure from the second end of the first framework is variable, means connecting the two end portions of the second arch structure to the second framework at the second end thereof so that the intermediate portion of the second arch structure is spaced from the plane of the second framework and the distance of the intermediate portion of the second arch structure from the first end of the second framework is variable, means for restricting movement of the arch structures relative to each other, a first portion of sheet material having edge regions connected respectively to the first arch structure and the first and second opposite sides of the first framework, a second portion of sheet material having edge regions connected respectively to the second arch structure and the first and second opposite sides of the second framework, and a third portion of sheet material having edge regions connected respectively to the first and second sides of the first and second frameworks, the first and second frameworks lying between the third portion of sheet material and the first and second portions of sheet material.

2. A construction assembly as claimed in claim 1, wherein the articulation means permit folding of the construction assembly to bring the two frameworks into confronting relationship with the two frameworks lying between the two portions of sheet material.

3. A construction assembly as claimed in claim 1, comprising a third arch structure similar to the first and second arch structures, and means connecting the two end portions of the third arch structure to the first framework at said second end thereof so that the intermediate portion of the third arch structure is spaced from the plane of the first framework to the same side of said plane as the intermediate portion of the first arch structure and the distance of the intermediate portion of the third arch structure from the first end of the framework is variable, said first portion of sheet material having an edge region connected to the third arch structure.

4. A construction assembly as claimed in claim 3, comprising a fourth arch structure similar to the first, second and third arch structures, and means connecting the two end portions of the fourth arch structure to the second framework at said first end so that the intermediate portion of the fourth arch structure is spaced from the plane of the second framework to the same side of said plane as the intermediate portion of the second arch structure and the distance of the intermediate portion of the fourth arch structure from the second end of the second framework is variable, said second portion of sheet material having an edge region connected to the fourth arch structure.

5. A construction assembly according to claim 1, wherein said third portion of sheet material is in two parts, a first part being connected to the first and second sides of said first framework and a second part being connected to the first and second sides of said second framework.

6. A construction assembly according to claim 5, wherein at least one additional arch structure is provided for supporting said two parts of said third portion of sheet material.

7. A construction assembly according to claim 1, wherein the first end of the first framework and the second end of the second framework are constituted by a single bar member.

* * * * *